US011913720B2

(12) United States Patent
Kaneda et al.

(10) Patent No.: US 11,913,720 B2
(45) Date of Patent: Feb. 27, 2024

(54) PRODUCT GAS SUPPLY QUANTITY ADJUSTMENT DEVICE AND AIR SEPARATION APPARATUS COMPRISING SAME

(71) Applicant: L'Air Liquide, Societe Anonyme pour l'Etude et l'Exploitation des Procedes Georges Claude, Paris (FR)

(72) Inventors: Takuya Kaneda, Kobe (JP); Shigenobu Kuwada, Kobe (JP)

(73) Assignee: L'Air Liquide Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 309 days.

(21) Appl. No.: 17/208,273

(22) Filed: Mar. 22, 2021

(65) Prior Publication Data

US 2021/0310732 A1 Oct. 7, 2021

(30) Foreign Application Priority Data

Apr. 2, 2020 (JP) ..... 2020-067079

(51) Int. Cl.
*F25J 3/04* (2006.01)

(52) U.S. Cl.
CPC ..... *F25J 3/04836* (2013.01); *F25J 3/04406* (2013.01); *F25J 3/04793* (2013.01); *F25J 3/04018* (2013.01); *F25J 3/04169* (2013.01); *F25J 3/04218* (2013.01); *F25J 2200/04* (2013.01); *F25J 2210/40* (2013.01);
(Continued)

(58) Field of Classification Search
CPC .. F25J 3/04848; F25J 3/04836; F25J 2290/10; F25J 2280/02; F25J 3/04406; F25J 3/04018
See application file for complete search history.

(56) References Cited

U.S. PATENT DOCUMENTS 2,788,646 A * 4/1957 Rice ..... F25J 3/04412 62/913
5,224,336 A * 7/1993 Agrawal ..... F25J 3/04351 62/656

(Continued)

FOREIGN PATENT DOCUMENTS

JP 2007 516 405 6/2007

*Primary Examiner* — Frantz F Jules
*Assistant Examiner* — Webeshet Mengesha
(74) *Attorney, Agent, or Firm* — Justin K. Murray

(57) ABSTRACT

A supply quantity adjustment device 500 comprises: a total demand quantity calculation unit 502 that calculates a total demand quantity used at a supply destination, based on plant information; an excess/deficit information setting unit 503 that compares the total demand quantity and a flow rate set value and sets a first calculated pressure value; a backup coefficient setting unit that sets a backup coefficient set value based on a reference gasholder pressure, the first calculated pressure value, a reference backup pressure set value, and a measured gasholder pressure value; and a production coefficient setting unit that compares a production pressure set value obtained by adding the reference gasholder pressure and a first pressure output value with the measured gasholder pressure value, and sets a production coefficient so as to modify a variation in the quantity of product gas produced by the air separation apparatus.

5 Claims, 6 Drawing Sheets

(52) U.S. Cl.
CPC ..... *F25J 2215/50* (2013.01); *F25J 2280/02* (2013.01); *F25J 2290/10* (2013.01)

(56) References Cited

U.S. PATENT DOCUMENTS

| | | | | |
|---|---|---|---|---|
| 6,006,546 | A * | 12/1999 | Espie | F25J 3/04575 700/270 |
| 6,116,027 | A * | 9/2000 | Smith | F25J 3/04381 60/648 |
| 6,957,153 | B2 * | 10/2005 | Esposito, Jr. | C01B 3/506 706/900 |
| 2005/0137810 | A1 * | 6/2005 | Esposito, Jr. | F25J 3/04848 702/32 |
| 2007/0221492 | A1 | 9/2007 | Guillard et al. | |

* cited by examiner

PRODUCT GAS SUPPLY QUANTITY ADJUSTMENT DEVICE AND AIR SEPARATION APPARATUS COMPRISING SAME

CROSS REFERENCE TO RELATED APPLICATIONS

This application claims the benefit of priority under 35 U.S.C. § 119 (a) and (b) to Japanese patent application No. JP2020-067079, filed Apr. 2, 2020, the entire contents of which are incorporated herein by reference.

FIELD OF THE INVENTION

The present invention relates to a product gas supply quantity adjustment device and air separation apparatus comprising the same.

BACKGROUND OF THE INVENTION

In an air separation apparatus installed, for example, in a steelmaking plant that requires highly concentrated oxygen gas, the quantity of highly concentrated oxygen gas (liquified oxygen gas) produced is adjusted in response to fluctuations in demand in the plant. In general, the production quantity is adjusted by monitoring the pressure in a low-pressure rectification column of the air separation apparatus and performing feedback control. Furthermore, operators predict and adjust the production quantity based on experience and intuition, on the basis of operational information such as planned demand in the plant.

However, when usage at the plant is in the batch mode, the demand quantity is not constant, and because there are not only cases of continuous day and night use, but also cases of use only during the night, it will be necessary to modify the reference value for the quantity produced by the air separation apparatus (reference set production quantity, which is set in advance) greatly in the transitional zone between day and night. Furthermore, the configuration allows a surplus of liquified oxygen gas to be produced in advance and stored in a buffer tank or the like, so that liquified oxygen gas can be supplied from the buffer tank as needed, if the production capacity of the air separation apparatus is not sufficient (for example, due to an inability to immediately respond to a large fluctuation in the production quantity or the like).

Furthermore, if the fluctuation in demand includes a great decrease there, the oxygen gas produced by the air separation apparatus is released into the atmosphere. As mentioned above, this is due to the fact that the production quantity is predicted by relying on the experience and intuition of the operator.

PCT International Application 2007-516405 discloses a facility that can supply high-purity oxygen and low-purity oxygen, depending on the usage in an industrial plant. A storage tank, serving as a source of high-purity oxygen, is also disclosed. However, as discussed above, there is no mention of adjusting the production quantity in response to fluctuations in demand in the plant.

SUMMARY OF THE INVENTION

Accordingly, an object of the present invention is to provide a supply quantity adjustment device that allows adjustment of the supply quantity of a product gas (for example, oxygen gas, nitrogen gas, argon gas, or the like) in a piping supply type on-site plant requiring a gas buffer, without relying on the experience and intuition of an operator, and allows the production quantity to be controlled by way of predicting demand fluctuations. Furthermore, an object of the present invention is to provide an air separation apparatus comprising the supply quantity adjustment device.

The supply quantity adjustment device (500) of the present invention comprises: a total demand quantity calculation unit (502) that calculates a total demand quantity (CPV_1) (for example, customer usage quantity or flow rate per unit time) used by at least one supply destination, based on plant information acquired from at least one supply destination (operation information, which is information on whether the plant is operating or not, supply quantity of product gas sent to the at least one supply destination (for example, the instantaneous value of flow rate of product gas sent (PV_f)) and/or a fixed value for the at least one supply destination (for example, expected usage value specific to the supply destination)); an excess/deficit information setting unit (503) that compares the total demand quantity (CPV_1) with a flow rate set value (SV_1) (for example, an average value for planned quantity) that is set in advance, and sets a first calculated pressure value (MV_1); a backup coefficient setting unit (504) that sets a backup coefficient set value (MV_bc) based on a pre-set supply-destination reference gasholder pressure (SV_gh, for example, the average target pressure value), the first calculated pressure value (MV_1), a pre-set reference backup pressure set value (SV_bc), and a measured gasholder pressure value (PV_gh), which is the measured pressure value of the supply-destination gasholder; and a production coefficient setting unit (505) that sets a production coefficient by comparing a production pressure set value (SV_a) obtained by adding the pre-set supply-destination reference gasholder pressure (SV_gh) and a first pressure output value (MV_1) with the measured gasholder pressure value (PV_gh), and sets a production coefficient (MV_a) so as to modify a variation in product gas production quantity by the at least one air separation apparatus.

The supply quantity adjustment device (500) may comprise a total production reference quantity acquisition unit (501) that acquires the total computed supply quantity (for example, a product gas generation capacity is computed by performing a computation based on a total production reference quantity, a flow rate per unit time, and the output of the feed air compressor in operation) of product gas that can be supplied from at least one air separation apparatus and at least one backup device (for example, a liquified oxygen storage tank, an evaporator or the like), or a total production reference quantity computation unit that computes a total computed supply quantity.

The excess/deficit information setting unit (503) may set the first calculated pressure value (MV_1) as a positive pressure value in a predetermined range when the total demand quantity (CPV_1) is greater than the flow rate set value (SV_1), and as a negative pressure value in a predetermined range when the opposite is the case.

The backup coefficient setting unit (504) may compare a first computed value (CPV_2), which is obtained by adding the pre-set supply-destination reference gasholder pressure (for example, the average target pressure value) and the first calculated pressure value (MV_1), with the reference backup pressure set value (SV_bc) for the product gas supplied from the backup device, so as to set a second calculated pressure value (MV_11) in a predetermined range.

The backup coefficient setting unit (504) may calculate a backup start pressure set value (SV_sbc) by adding the reference backup pressure set value (SV_bc) and the second calculated pressure value (MV_11).

The backup coefficient setting unit (504) may compare the backup start pressure set value (SV_sbc) with the measured gasholder pressure value (PV_gh), which is the measured pressure value for the supply-destination gasholder, and set the backup coefficient set value (MV_bc).

The production coefficient setting unit (505) may set the production coefficient set value (MV_a) so as to maintain or increase the production quantity of the product gas by the at least one air separation apparatus when the measured gasholder pressure value (PV_gh) is less than the production pressure set value (SV_a), and to decrease the production quantity when the opposite is the case.

The supply quantity adjustment device (500) may comprise: a first control/command unit (506) that commands an outlet valve of the backup device or a gate valve or control valve installed on the piping connecting the backup device and the supply destination, based on the backup coefficient set value (MV_bc), to control starting of supply, variation of supply quantity, and stopping of supply, of the product gas from the backup device; and a second control/command unit (507) that commands an air separation apparatus to maintain or vary the quantity of product gas produced by at least one air separation apparatus based on the production coefficient set value (MV_a).

In another aspect, an air separation apparatus comprises the supply quantity adjustment device (500) described above.

In certain embodiments, the air separation apparatus (100) can include: a first compressor (C1) that compresses feed air; a flow rate measurement unit (F1) that measures the flow rate of the feed air downstream from the first compressor (C1) (upstream or downstream of a main heat exchanger (1)); the main heat exchanger (1), to which feed air downstream from the first compressor (C1) is introduced, and which exchanges heat (with a heat source); a purification section, to which feed air output from the main heat exchanger (1) is supplied, and which separates and purifies a product gas (high-purity oxygen gas) from said feed air; and a backup device that stores the high-purity liquified oxygen produced in the purification section.

In certain embodiments, the purification section can include: a high-pressure column (2) into which feed air that has passed through the main heat exchanger (1) is introduced; a condenser section (3) that condenses high-pressure column distillate output from the top section (23) of the high-pressure column (2); and a low-pressure column (4) into which oxygen-enriched liquid output from the bottom section (21) of the high-pressure column (2) is introduced, wherein the high-purity liquified oxygen from the liquid phase section (31) at the bottom of the condenser section (3) may be sent to the backup device (after having been pressurized by a pressurization device).

In certain embodiments, the air separation apparatus may include: a product gas supply line (L31) that supplies product liquified gas to the plant 400, after the product liquified gas (high-purity liquified oxygen gas), which is output from the liquid phase section (31) at the bottom of the condenser section (3), is passed through the main heat exchanger (1) for gasification and heat exchange; and a backup supply line (L102) that evaporates (in a heat exchange unit (E102)) high-purity liquified oxygen output from the backup device, and provides supply to the plant (400) in the form of high-pressure high-purity oxygen gas.

In certain embodiments, a flow rate measurement unit, a pressure measurement unit, a gate valve, a control valve and the like may be provided at the product gas supply line (L31).

In certain embodiments, the backup device may comprise a backup tank (101), the backup supply line (L102), the heat exchange unit (E102) (or an evaporator), a control valve (V102), a flow rate measurement unit (F102), a gate valve, and a pressure measurement unit and the like.

In certain embodiments, the air separation apparatus or the supply quantity adjustment device (500) may include: a control unit (200) that controls the supply quantity (introduction quantity) of the feed air (controls the discharge quantity from the compressor C1) according to the variation in the production quantity of the product gas (high-purity oxygen gas).

In certain embodiments, the purification section may further include a crude argon column, a high-purity purified argon column, a heat exchanger, and the like.

(Method, Software Program, and Storage Media Aspects)

In certain embodiments, the supply quantity adjustment method of the present invention comprises the following steps of calculating a total demand quantity (CPV_1) (for example, customer usage quantity or flow rate per unit time) used by at least one supply destination, based on plant information acquired from at least one supply destination (operation information, which is information on whether the plant is operating or not, supply quantity of product gas sent to the at least one supply destination (for example, the instantaneous value (PV_f) of flow rate of product gas sent) and/or a fixed value for the at least one supply destination (for example, expected usage value specific to the supply destination));

comparing the total demand quantity (CPV_1) and a pre-set flow rate set value (SV_1) (for example, the average planned quantity value) and setting a first calculated pressure value (MV_1);

setting a backup coefficient set value (MV_bc) based on a pre-set supply-destination reference gasholder pressure (SV_gh, for example, the average target pressure value), the first calculated pressure value (MV_1), a pre-set reference backup pressure set value (SV_bc), and a measured gasholder pressure value (PV_gh), which is the measured pressure value of the supply-destination gasholder; and setting a production coefficient (MV_a) by comparing a production pressure set value (SV_a) obtained by adding the pre-set supply-destination reference gasholder pressure (SV_gh) and a first pressure output value (MV_1) with the measured gasholder pressure value (PV_gh), so as to modify a variation in product gas production quantity by the at least one air separation apparatus.

In certain embodiments, the supply quantity adjustment method may further comprise the following steps of:

a total production reference quantity acquisition unit (501) that acquires the total computed supply quantity (for example, a product gas generation capacity is computed by performing a computation based on a total production reference quantity, a flow rate per unit time, and the output of the feed air compressor in operation) of product gas that can be supplied from at least one air separation apparatus and at least one backup device (for example, a liquified oxygen storage tank, an evaporator, or the like), or computing a total computed supply quantity.

In certain embodiments, the supply quantity adjustment method may further comprise the following steps of:

commanding an outlet valve of the backup device or the gate valve or control valve installed on the piping connecting the backup device and the supply destination, based on the backup coefficient set value (MV_bc), to control starting of supply, variation of supply quantity, and stopping of supply, of the product gas from the backup device; and commanding the air separation apparatus to maintain or vary the quantity of product gas produced by at least one air separation apparatus based on the production coefficient set value (MV_a).

Furthermore, in another aspect, an information processing device can include: at least one processor; and a memory for storing instructions executable by the processor, wherein the processor is an information processing device that realizes the supply quantity adjustment method described above by executing executable instructions.

Furthermore, in another aspect, a supply quantity adjustment program is a program that realizes the supply quantity adjustment method described above by way of at least one processor.

Furthermore, another aspect is a computer-readable recording medium in which computer instructions are stored, wherein the computer instructions are executed by a processor to realize the steps of the supply quantity adjustment method described above.

In certain embodiments, the following advantages can be seen:

(1) Because the demand can be forecast accurately without relying on the experience and intuition of operators, the release-loss due to excess oxygen gas production can be reduced;

(2) The backup gas, which is obtained by supplying and evaporating liquified oxygen from the backup device, when there is a deficiency, can also be reduced;

(3) The quantity of oxygen gas generated from the air separation apparatus and the evaporated supply of liquified oxygen from the backup device can be varied automatically, which improves reliability by improving reproducibility; and/or (4) In adjusting the supply quantity (production quantity and backup supply quantity) in response to fluctuations in demand quantity (usage quantity), oxygen gas and liquified oxygen losses can be reduced by adjusting the reaction speed or the like so as to respond immediately to fluctuations (the lowest past value can be maintained).

DETAILED DESCRIPTION OF THE INVENTION

Several modes of embodiment of the present invention will be described below. The modes of embodiment described below are exemplary descriptions of the present invention. The present invention is in no way limited by the following modes of embodiment, and also includes a number of variant modes which are implemented within a scope that does not alter the gist of the present invention. It should be noted that the constituent elements described below are not all limited to being essential constituent elements of the present invention.

Mode of Embodiment 1

Figure 1:
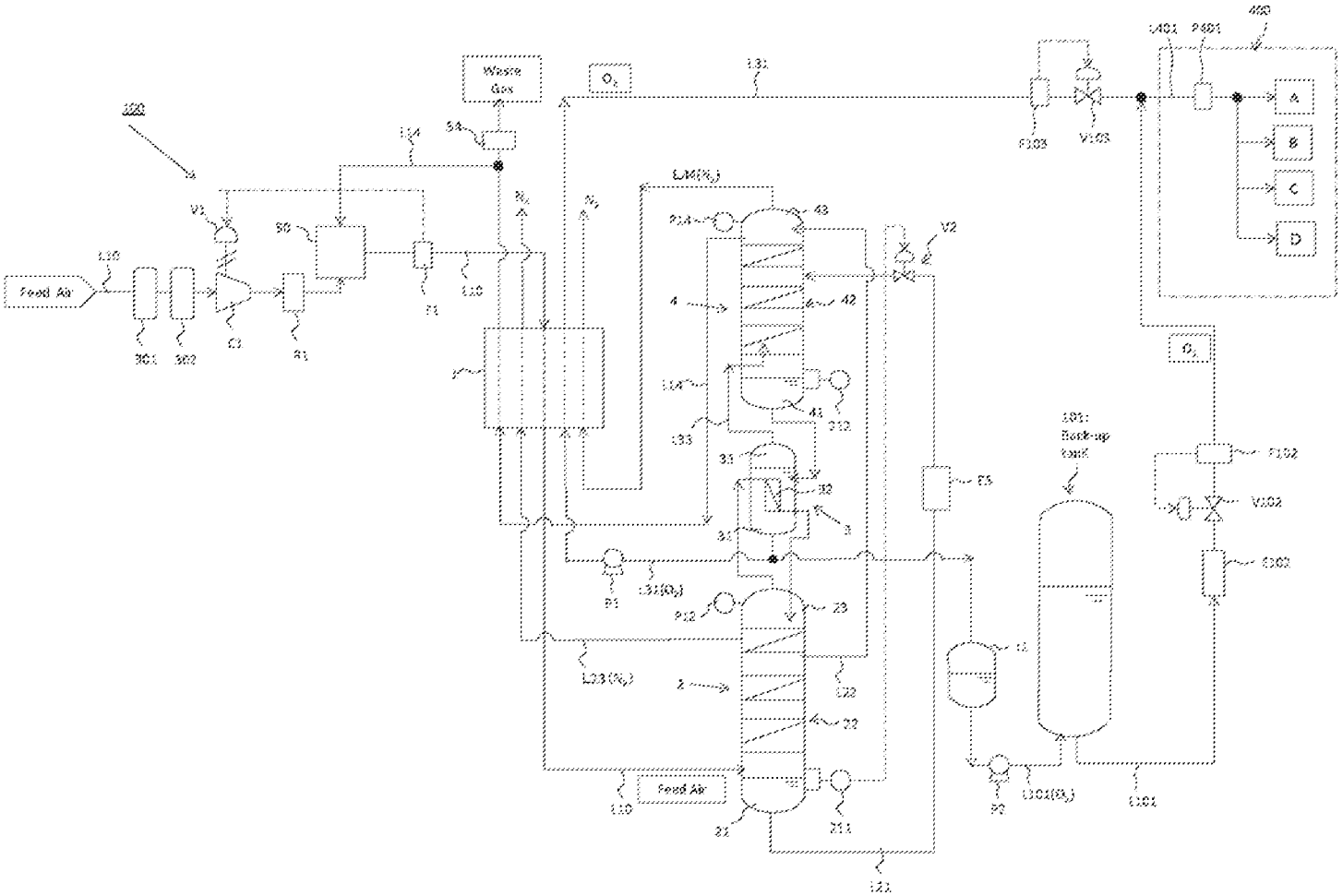
FIG. 1 shows an air separation apparatus and a supply quantity adjustment device of Mode of Embodiment 1.

An air separation apparatus 100 of Mode of Embodiment 1 will be described using FIG. 1.

Raw air (Feed Air) passes through a filtration means 301 and a catalyst column 302 on a route (piping) L10, to remove foreign matter and solids in the air. Compressed feed air, which has been compressed by a compressor C1 installed on the route L10, is sent to a first refrigerator R1 to be cooled to a predetermined temperature. The cooled compressed feed air is sent to a pre-purification section 50. The pre-purification section 50 comprises, for example, a first adsorption column (not shown) and a second adsorption column (not shown) installed adjacent to the first adsorption column, for removing carbon dioxide and/or water. Adsorption processing is performed in one adsorption column and regeneration processing is performed in the other column, with the adsorption processing and the regeneration processing being performed alternately. Feed air that has been pre-purified in the first adsorption column or second adsorption column is introduced to a downstream main heat exchanger 1 via the route L10.

A flow rate measurement unit F1, which measures the flow rate of the feed air (introduction rate) is provided on the route L10, between the pre-purification section 50 and the main heat exchanger 1, and the processing flow rate is adjusted by an inlet guide vane (V1) of the compressor C1, based on flow rate data from the flow rate measurement unit F1. This measurement data is sent to the control unit 200 and stored as time series data in the second memory 205.

(Configuration of the Purification Section)

The air separation apparatus 100 comprises the main heat exchanger 1, a high-pressure column 2, into which feed air having passed through the main heat exchanger 1 is introduced via the piping L10, a condenser section (nitrogen condenser) 3 that condenses high-pressure column distillate output from the top section 23 of the high-pressure column 2, and a low-pressure column 4 into which an oxygen-enriched liquid output from the bottom section 21 of the high-pressure column 2 is introduced.

The high-pressure column 2 has: a bottom section 21 having a gas phase section into which feed air having passed through the main heat exchanger 1 is introduced and a liquid phase section in which oxygen-enriched liquid is stored; a purification section 22 provided above the bottom section 21; and a top section 23 provided above the purification section 22.

The top section 23 is provided with a pressure measurement unit P12, which measures the pressure in the top section 23. A liquid level measurement unit 211, which measures the liquid level height of the oxygen-enriched liquid, is provided for the bottom section 21 of the high-pressure column 2. This measurement data is sent to the control unit 200 and stored as time series data in the second memory 205.

The oxygen-enriched liquid, which is output from the bottom section 21, is introduced via piping L21 to a rectification level that is the same as, or vertically close to, a middle level in a rectification section 42 of the low-pressure column 4, after being subjected to heat exchange in a heat exchanger E5. A control valve V2 is provided on the piping L21, and the control valve V2 is controlled by the control unit 200, in accordance with measurement data from the liquid level measurement unit 211, so as to adjust the quantity of oxygen-enriched liquid introduced.

The high-pressure column distillate (reflux liquid), which is output from the top section 23 of the high-pressure column 2 via a route (piping) L23, is sent to the main heat exchanger 1.

The gas (gas-liquid mixture) output from the upper stage of the rectification section 22 of the high-pressure column 2 is sent to the top section 43 of the low-pressure column 4 via a route L22.

The condenser 3 has a liquid phase section 31, which stores the highly oxygen-enriched liquid ($O_2$) output from the bottom section 41 of the low-pressure column 4, a refrigeration section 32, which cools the high-pressure column distillate output from the top section 23 of the high-pressure column 2, using the liquid phase section 31 as a cooling source, and a gas phase section 33 above the liquid phase section 31.

The high-pressure column distillate that has been cooled in the refrigeration section 32 returns to the top section 23 of the high-pressure column 2 and is sent to the purification section 22. Some of the highly oxygen-enriched liquid ($O_2$) used for heat exchange in the refrigeration section 32 becomes gaseous and is sent from the gas phase section 33 to the lower part of the rectification section 42 of the low-pressure column 4 via piping L33.

Meanwhile, the highly oxygen-enriched liquid ($O_2$) in the liquid phase section 31 is boosted by a pump P1 installed on the piping L31 and sent to the main heat exchanger 1 and, after being subject to gasification and heat exchange, is sent to the plant 400. Furthermore, the highly oxygen-enriched liquid ($O_2$) in the liquid phase section 31 is sent to a product tank t1 via piping L102. The highly oxygen-enriched liquid (O2) is output from the product tank t1, boosted by a pump P2, and sent to a backup tank 101 to be used as backup oxygen. The oxygen concentration of the highly oxygen-enriched liquid ($O_2$) is greater than the oxygen concentration of the oxygen-enriched liquid.

The low-pressure column 4 has a bottom section 41, which stores the highly oxygen-enriched liquid ($O_2$), a purification section 42 provided above the bottom section 41, and a top section 43 provided above the purification section 42.

The top section 43 is provided with a pressure measurement unit P14, which measures the pressure in the top section 43. A liquid level measurement unit 212, which measures the liquid level height of the highly oxygen-enriched liquid ($O_2$), is provided at the bottom section 41 of the low-pressure column 4. The measurement data is sent to the control unit 200 and stored as time series data in the second memory 205.

Waste gas (low-pressure column top distillate) which has been output from the top section 43 is sent to the main heat exchanger 1 via route L14, and is subsequently used as regeneration gas for the first adsorption column or the second adsorption column. Furthermore, the (pressure top distillate that has been output from the top section 43 is sent to the main heat exchanger 1, directly, or after being subjected to heat exchange in the heat exchanger E5, via the route L44. The gas that has been output from the gas phase section of the bottom section 41 merges into the route L33 and is sent to the main heat exchanger 1.

A vent 54, which releases waste gas, is provided between the pre-purification section 50 on the route L14 and the main heat exchanger 1.

A product gas supply line L33 supplies, to the plant 400, product gas (high-purity oxygen gas), which is output from the upper gas phase section 33 of the condenser section 3 and/or the lower part of the rectification section 42 or the upper part of the bottom section 41 of the low-pressure column 4 (between them), having been passed through the main heat exchanger 1 and subjected to heat exchange.

The product gas supply line L33 is provided with a product gas flow rate measurement unit F103, which measures the flow rate of the product gas (high-purity oxygen gas) and a control valve V103 that controls the supply quantity of the product gas based on the flow rate measured by the product gas flow rate measurement unit F103. This measurement data is sent to a supply quantity adjustment device 500 and stored as time series data in a first memory 509.

With the backup supply line L102, high-purity liquified oxygen, which is output from the backup tank 101, is evaporated in a heat exchange unit E102, and supplied to the plant 400 as high-purity oxygen gas.

The backup supply line L102 is provided with a backup gas flow rate measurement unit F102 that measures the flow rate of high-purity oxygen gas, and a control valve V102 that controls the supply quantity of backup gas, based on the flow rate measured by the backup gas flow rate measurement unit F102. This measurement data is sent to a supply quantity adjustment device 500 and stored as time-series data in a first memory 509.

The plant 400 is equipped with a line L401, resulting from merging the product gas supply line L33 and the backup supply line L102, which sends product gas to demand destinations, and a gasholder pressure measurement unit P401, which measures gasholder pressure, and which is provided on the line L401. This measurement data is sent to a supply quantity adjustment device 500 and stored as time-series data in a first memory 509.

The plant 400 is provided with demand destinations (usage destinations) A, B, C, and D.

(Configuration of the Supply Quantity Adjustment Device)

Figure 2:
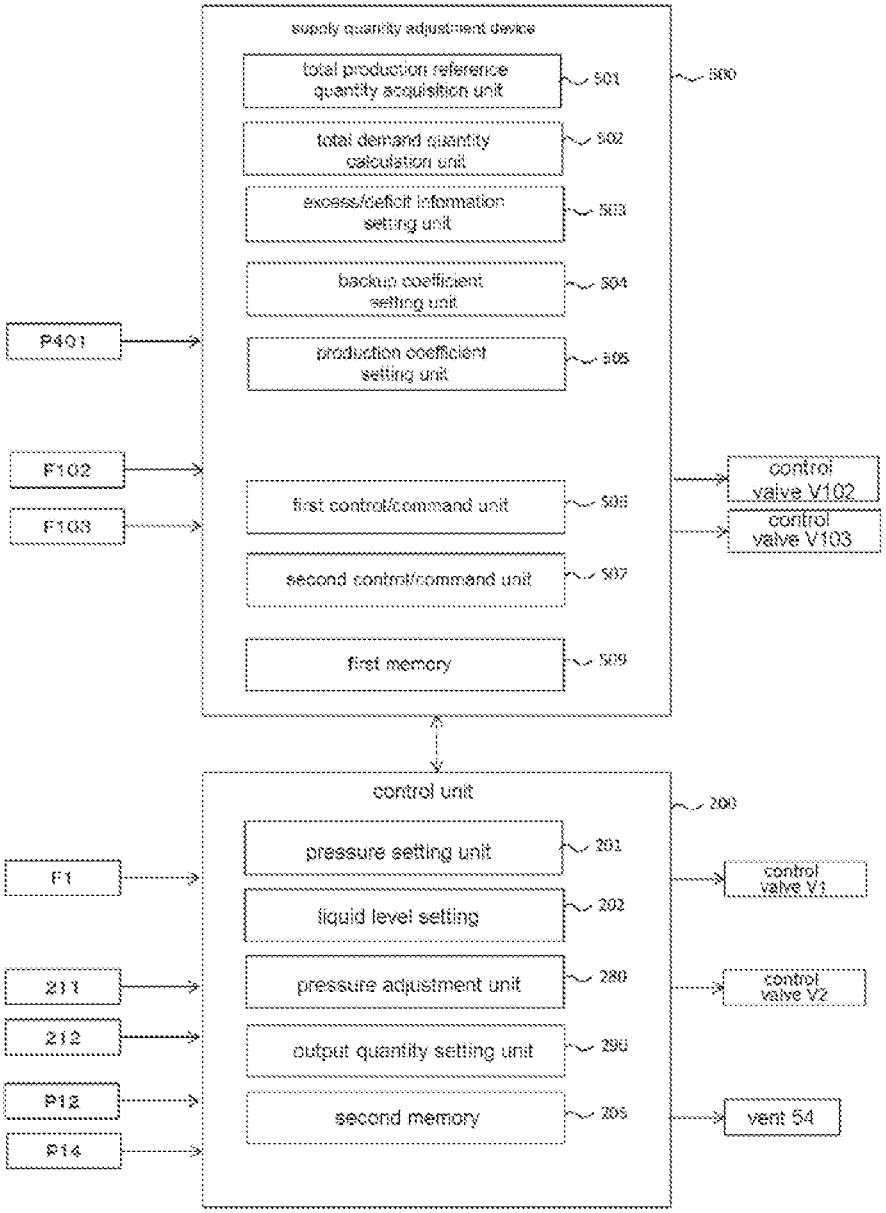
FIG. 2 shows an example of a control element of the supply quantity adjustment device of Mode of Embodiment 1.
Figure 3:
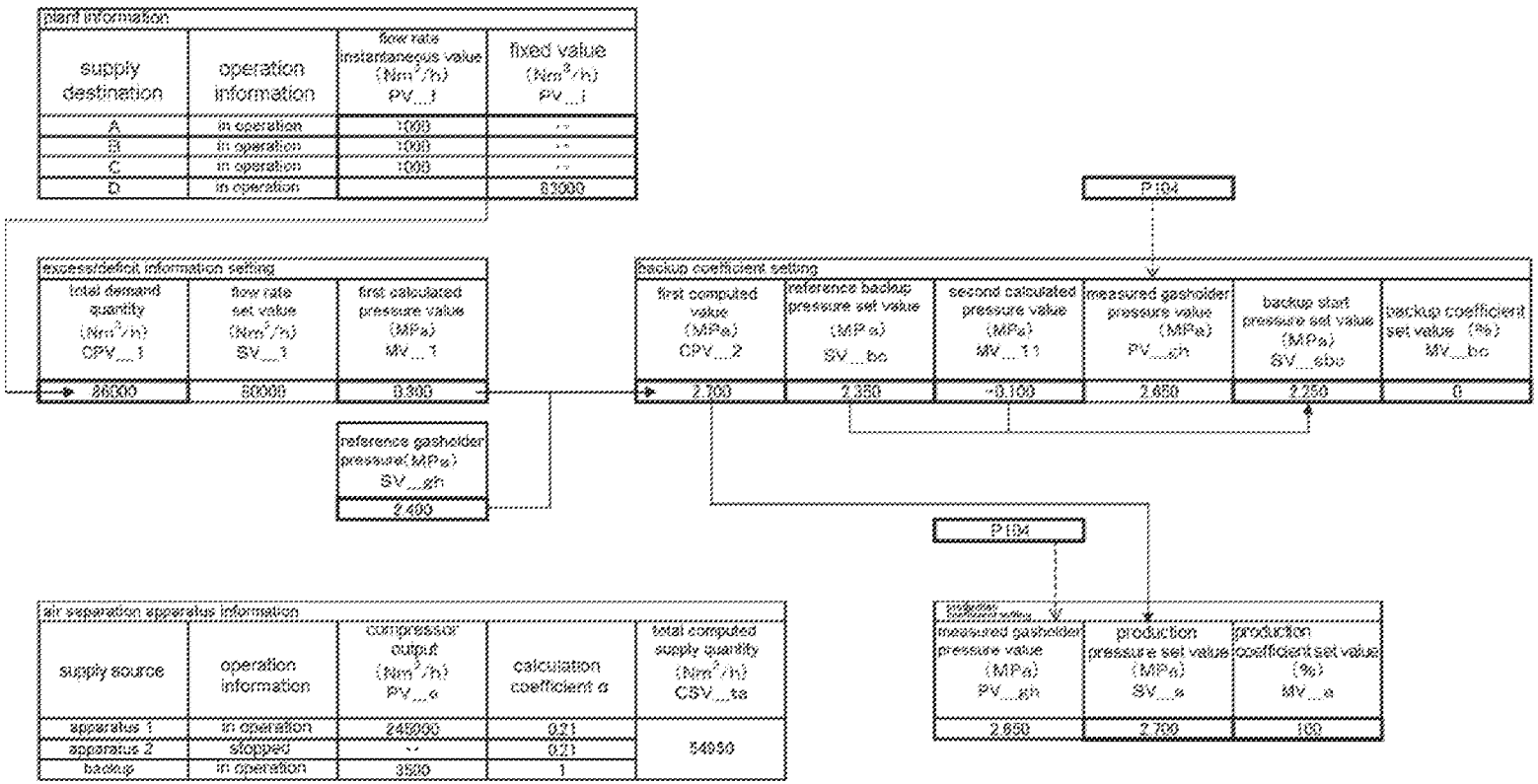
FIG. 3 shows an example of a calculation step in the supply quantity adjustment device of Mode of Embodiment 1.

FIG. 2 shows the configuration of the supply quantity adjustment device 500. FIG. 3 shows an example of a calculation step in the supply quantity adjustment device.

A total production reference quantity acquisition unit 501 acquires the total computed supply quantity (CSV_ta) of high-purity oxygen gas that can be supplied from the air separation apparatus 100 and the backup tank 101. In the present mode of embodiment, the total computed supply quantity (CSV_ta) is obtained, for example, based on a total production reference quantity, a flow rate per unit time, the output of the feed air compressor C1 in operation (or the flow rate from the flow rate measurement unit F1), by way of multiplication with a calculation coefficient (a) (also referred to as the product gas generation capacity). The control unit that operates the air separation apparatus 100 may compute the total computed supply quantity (CSV_ta), and the supply quantity adjustment device 500 may acquire that result, or the supply quantity adjustment device 500 may compute the total computed supply quantity (CSV_ta).

A total demand quantity calculation unit 502 calculates a total demand quantity (CPV_1) that is used at the plant 400, based on: operation information, which is information on whether the plant 400 is operating or not, and is acquired from the plant 400, which is the supply destination; and the supply quantity of product gas sent to the plant 400. The total demand quantity (CPV_1) is calculated from, for example, the instantaneous value of the flow rate of the product gas sent (PV_f)) and/or a fixed value for the supply-destination plant 400 (for example, a supply destination-specific expected usage value; SV_i).

The total demand quantity (CPV_1) is also referred to as customer usage quantity (flow rate per unit time).

In FIG. 3, the total demand quantity (CPV_1) is obtained by adding the instantaneous values (PV_f) for supply destinations A, B, and C and the fixed value (SV_i) for supply destination D.

An excess/deficit information setting unit 503 compares the total demand quantity (CPV_1) with a flow rate set value (SV_1) which is set in advance (for example, the average value for planned quantity, the past actual average value or the like) and sets a first calculated pressure value (MV_1).

For example, when the total demand quantity (CPV_1) is greater than the flow rate set value (SV_1), the first calculated pressure value (MV_1) is set to a positive pressure value in a predetermined range (for example, 0.100 MPa to 0.500 MPa) and when the total demand quantity (CPV_1) is less than the flow rate set value (SV_1), the first calculated pressure value (MV_1) is set to a negative pressure value in a predetermined range (for example, −0.100 MPa to −0.500 MPa).

The first calculated pressure value (MV_1) may be set to a value proportional to the slope of the change in the total demand quantity (CPV_1), or the value may be set to a larger value proportional to the rate of change in the slope per unit time. When the rate of change in the slope is greater than a pre-set threshold, the first calculated pressure value (MV_1) may be set, for example, to 1.1 to 2.0 times the normal setting.

A backup coefficient setting unit 504 adds a pre-set supply-destination reference gasholder pressure (average target pressure value, for example, 2.400 MPa) and the first calculated pressure value (MV_1) to find a first computed value (CPV_2, 2.700 MPa). Next, the backup coefficient setting unit 504 compares the first computed value (CPV_2, 2.700 MPa) and the reference backup pressure set value (SV_bc, 2.350 MPa) of the product gas supplied from the backup tank 101 and sets the second calculated pressure value in a predetermined range (MV_11, for example, −0.100 MPa to −0.500 MPa).

For example, the second calculated pressure value (MV_11) is such that the second calculated pressure value (MV_11) is set to a high value when the first computed value (CPV_2) is higher than the reference backup pressure set value (SV_bc), and is set to a low value when the first computed value (CPV_2) is lower than the reference backup pressure set value (SV_bc).

The second calculated pressure value (M_11) may be set to a value proportional to the slope of the change in the total demand quantity (CPV_1), and further, may be set to a larger value proportional to rate of change in the slope per unit time. When the rate of change in the slope is greater than a pre-set threshold, the second calculated pressure value (MV_11) may be set, for example, to 1.1 to 2.0 times the ordinary setting.

Next, the backup coefficient setting unit 504 adds the reference backup pressure set value (SV_bc, 2.350 MPa) and the second calculated pressure value (MV_11, −0.100 MPa) to calculate the backup start pressure set value (SV_sbc, 2.250 MPa). Here, the backup gas supply start timing can be made earlier by setting the backup start pressure set value (SV_sbc) to a lower value than the reference backup pressure set value (SV_bc).

Next, the backup coefficient setting unit 504 compares the backup start pressure set value (SV_sbc, 2.250 MPa) and the measured gasholder pressure value (PV_gh, 2.650 MPa) and sets the backup coefficient set value (MV_bc, 0% to 100%).

For example, when the backup start pressure set value (SV_sbc, 2.250 MPa) is less than the measured gasholder pressure value (PV_gh, 2.650 MPa) the backup coefficient set value (MV_bc) may be set to 0%, and when the backup start pressure set value (SV_sbc) is greater than the measured gasholder pressure value (PV_gh), the backup coefficient set value (MV_bc) may be set to 1 to 100%. Here, "0%" means that the backup supply stops, and "1% to 100%" means that supply is performed proportionally to the ratio of "1 to 100%" with the maximum possible supply at the current time being 100%.

When the usage quantity (demand) is a predetermined multiple (for example, 1.5 times or more) of the production quantity of the high-purity oxygen gas and the rate of decrease in the measured gasholder pressure value (PV_gh) is rapid (for example, a decrease rate of 1.5 times or more the average rate decrease) the backup coefficient set value (MV_bc) may be set to a higher value than in other cases.

The production coefficient setting unit 505 adds a pre-set plant 400 reference gasholder pressure (SV_gh, average target pressure value, for example, 2.400 MPa) and the first pressure output value (MV_1, 0.300 MPa) to calculate the production pressure set value (SV_a, 2.700 MPa). The production pressure set value (SV_a, 2.700 MPa) is the same as the first computed value (CPV_2) and therefore the first computed value (CPV_2) may be used as is.

The production coefficient setting unit 505 compares the production pressure set value (SV_a) and the measured gasholder pressure value (PV_gh, 2.650 MPa) and sets the production coefficient set value (MV_a, 0% to 100%) to modify the variation of the production quantity of the product gas by the air separation apparatus 100.

For example, when the measured gasholder pressure value (PV_gh, 2.650 MPa) is less than the production pressure set value (SV_a, 2.700 MPa), the production coefficient set value (MV_a) may be set to 100%, and when the measured gasholder pressure value (PV_gh) is greater than the production pressure set value (SV_a) the production coefficient set value (MV_a) may be set to 0 to 99%. Here, "100%" means maintaining the current production quantity of the air separation apparatus, and "1% to 99%" means reducing the production quantity to "1 to 99%", with the current production quantity being 100%.

When the usage quantity (demand) is a predetermined multiple (for example, 1.5 times or more) of the production quantity of the high-purity oxygen gas and the rate of decrease in the gasholder pressure measurement value (PV_gh) is rapid (for example, a decrease of 1.5 times or more the average rate decrease) the manufacturing coefficient set value (MV_a) may be set to a higher value than in other cases.

A first control/command unit 506 controls the starting of supply of high-purity oxygen gas from the backup tank 101, the variation in the supply quantity, and the stopping of the supply, based on the backup coefficient set value (MV_bc).

The first control/command unit 506 commands the outlet valve of the backup tank 101 (not shown) and the control valve V102 provided in the backup supply line L101 connecting the backup tank 101 and the plant 400. The first control/command unit 506 drives the heat exchange unit E102. The first control/command unit 506 may command the control valve V102 to control the flow rate based on the data measured by the backup gas flow rate measurement unit F102.

High-purity liquified oxygen is taken from the backup tank 101 and evaporated by the heat exchange unit E102 to become high-pressure, high-purity oxygen gas, which is merged into the product gas piping L33 and supplied to the plant 400.

In the description in FIG. 3, because the backup coefficient set value (MV_bc) is "0%", the first control/command unit 506 keeps the backup supply stopped.

The second control/command unit 507 commands the air separation apparatus 100 to maintain or vary the quantity of product gas produced by the air separation apparatus 100, based on the production coefficient set value (MV_a).

The second control/command unit 507 may command the control unit 200 of the air separation apparatus 100.

In the description in FIG. 3, because the production coefficient set value (MV_a) is "100%", the second control/command unit 507 performs a command so as to maintain the current production quantity.

Figure 4:
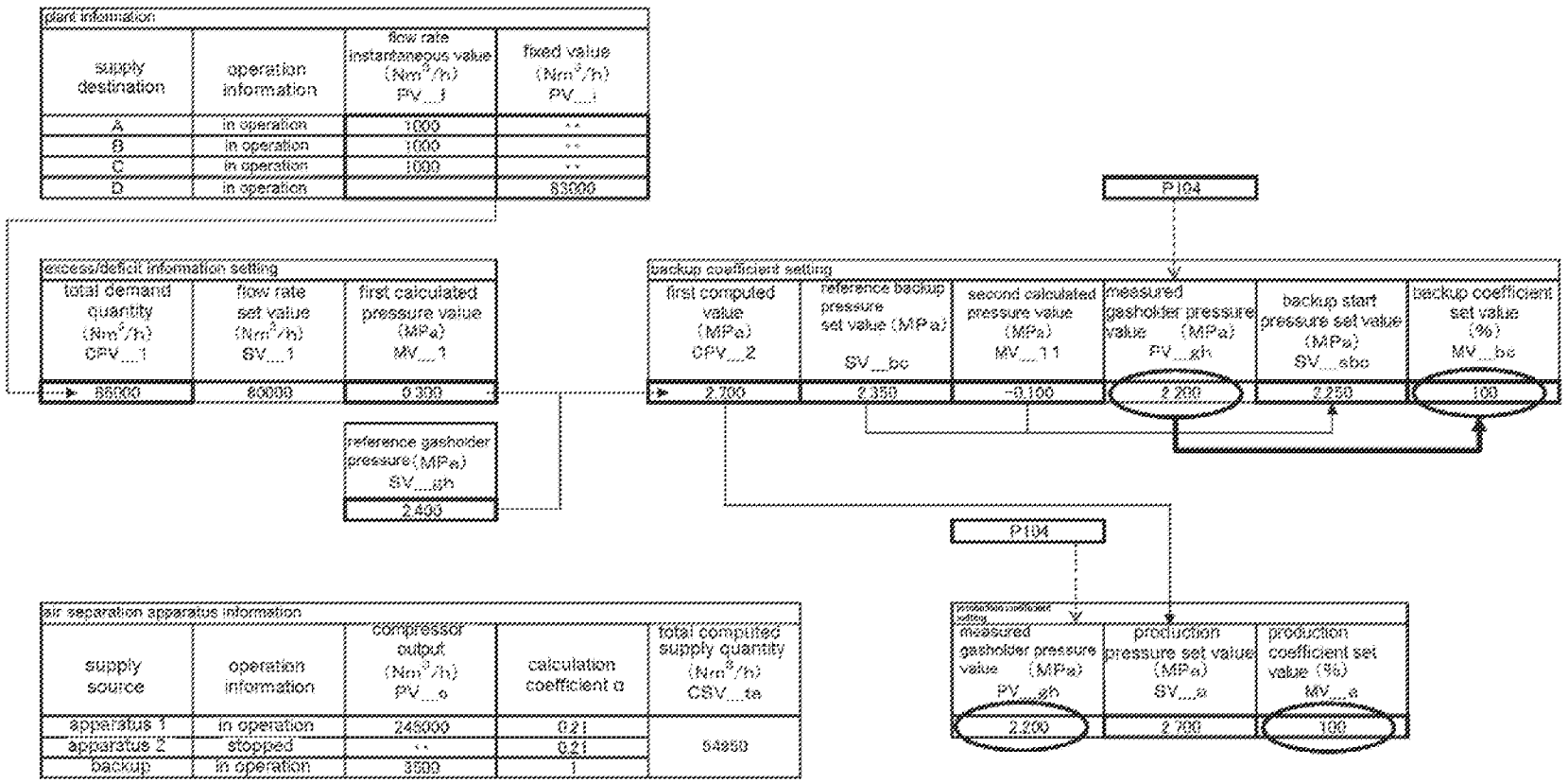
FIG. 4 shows an example of a calculation step (starting backup supply) in the supply quantity adjustment device of Mode of Embodiment 1.

Next, using FIG. 3 as a starting point, an example of a case in which demand increases is shown in FIG. 4.

In FIG. 4, the measured gasholder pressure value (PV_gh) measured by the gasholder pressure measurement unit P401 decreases from "2.650" to "2.200" MPa. Due to this fluctuation, the measured gasholder pressure value (PV_gh) becomes less than the backup start pressure set value (SV_sbc, 2.250 MPa), such that it is necessary to supply backup gas, and the backup coefficient set value (MV_bc) is set to 100%. Since the backup coefficient set value (MV_bc) is now "100%", the first control/command unit 506 commands the control elements so as to start backup supply.

Meanwhile, because the measured gasholder pressure value (PV_gh, 2.200 MPa) is less than the production pressure set value (SV_a, 2.700 MPa), and the production coefficient set value (MV_a) is still "100%", the second control/command unit 507 performs a command so as to maintain the current production quantity.

Figure 5:
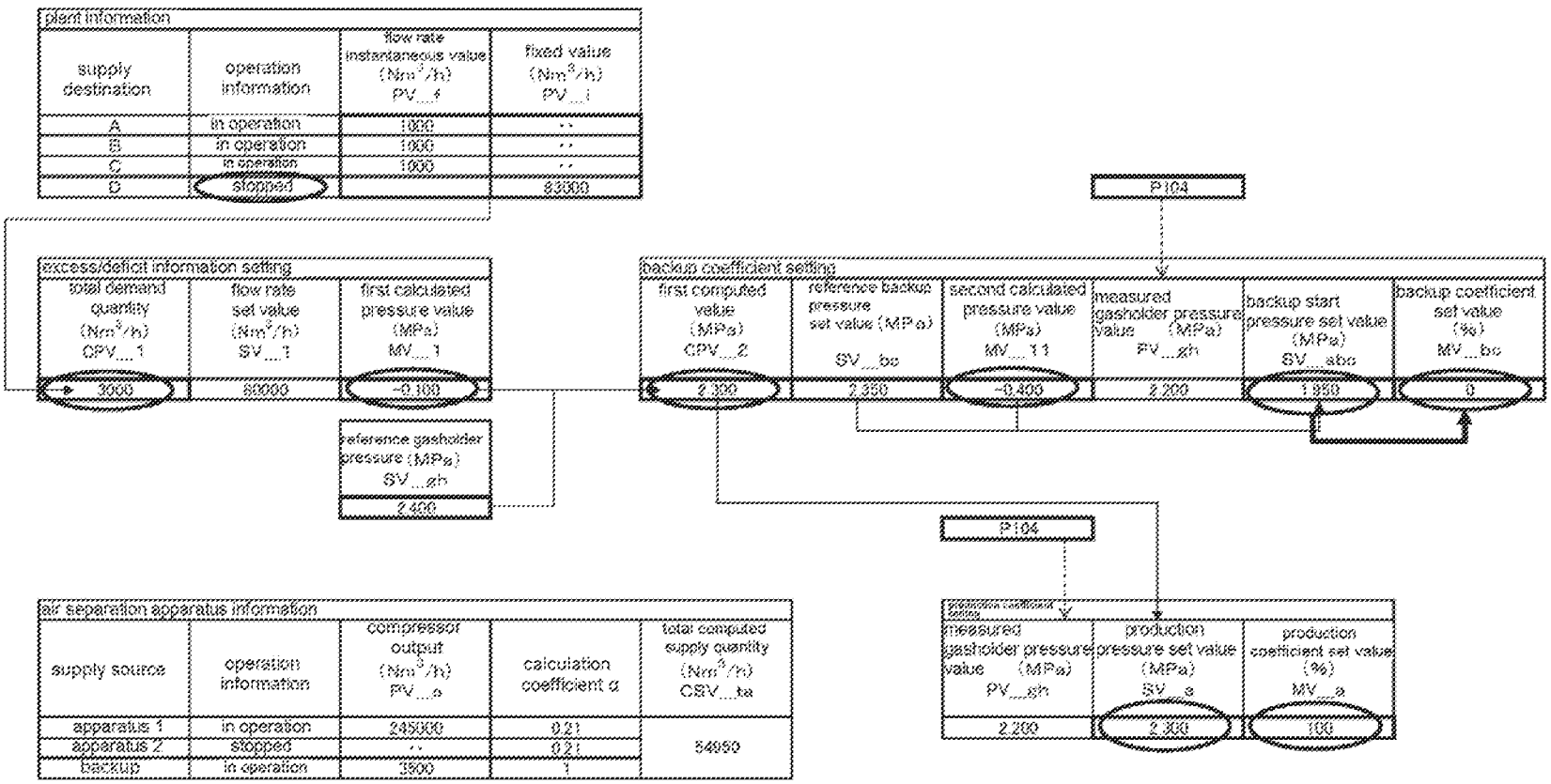
FIG. 5 shows an example of a calculation step (stopping backup supply) in the supply quantity adjustment device of Mode of Embodiment 1.

Next, using FIG. 4 as a starting point, an example of a case in which demand has been reduced (stopping backup gas supply) is shown in FIG. 5.

In FIG. 5, the total demand quantity (CPV_1) has decreased to "3000" due to the supply destination D changing from "in operation" to "stopped". Furthermore, the first calculated pressure value (MV_1) is set to "−0.100" because the total demand quantity (CPV_1) is much smaller than the flow rate set value (SV_1). Furthermore, the first computed value (CPV_2) is "2.300" and thus, the second calculated pressure value (MV_11) is changed from "−0.100" to "−0.400" and the backup start pressure set value (SV_sbc) is changed from "2.250" to "1.950". Furthermore, since the measured gasholder pressure value (PV_gh) is greater than the backup start pressure set value (SV_sbc), there is no longer a need to supply backup gas, and the backup coefficient set value (MV_bc) is set to "0%". The first control/command unit 506 commands the control elements so as to stop backup supply.

Meanwhile, because the measured gasholder pressure value (PV_gh, 2.200 MPa) is less than the production pressure set value (SV_a, 2.300 MPa), and the production coefficient set value (MV_a) is still "100%" the second control/command unit 507 performs a command so as to maintain the current production quantity.

Figure 6:
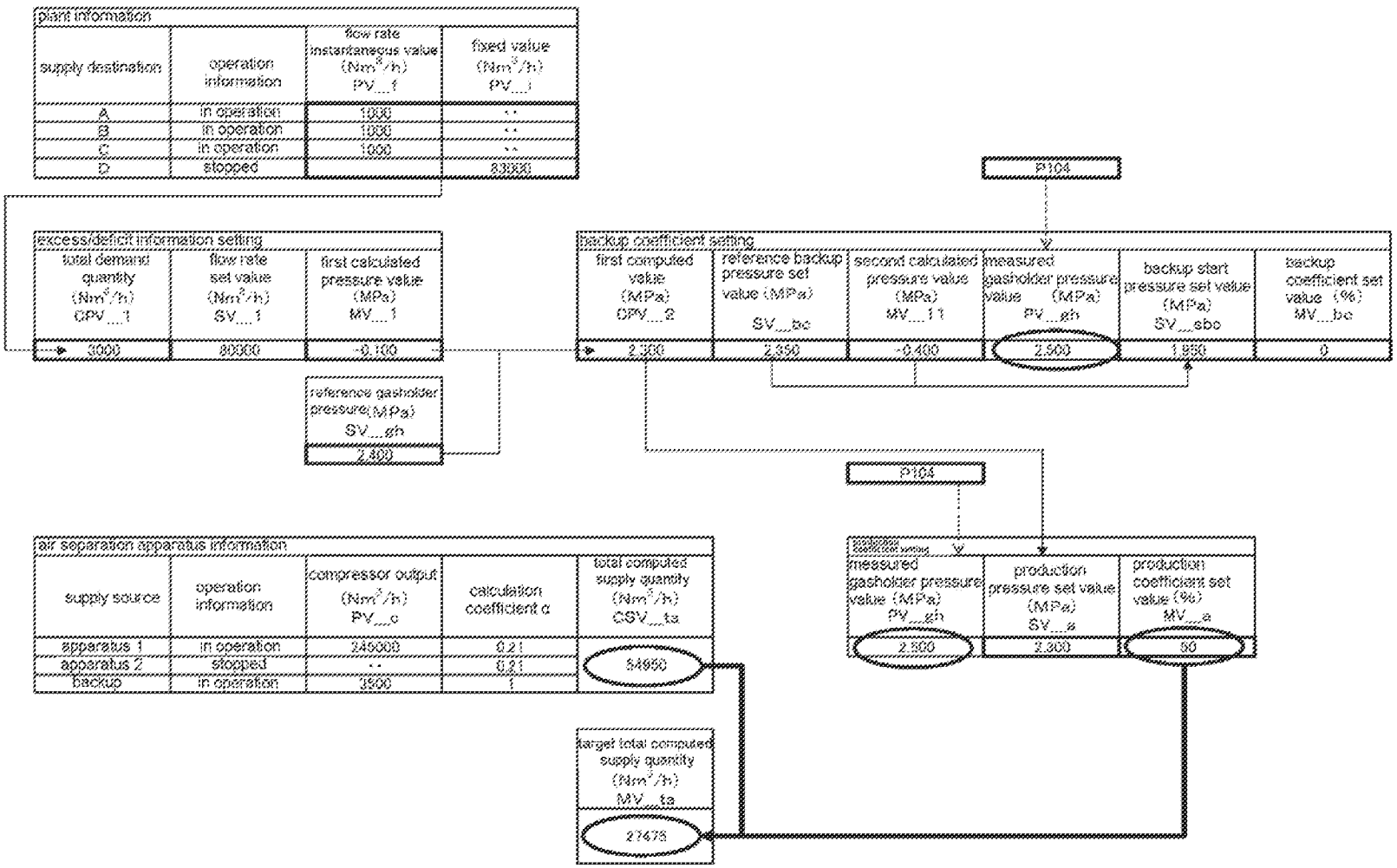
FIG. 6 shows an example of a calculation step (reducing the quantity produced by the air separation apparatus) in the supply quantity adjustment device of Mode of Embodiment 1.

Next, using FIG. 5 as a starting point, an example of a case in which demand has further decreased is shown in FIG. 6 (decrease in production quantity).

In FIG. 6, the measured gasholder pressure value (PV_gh) has increased from "2.200" to "2.500". Since the measured gasholder pressure value (PV_gh) is still greater than the backup start pressure set value (SV_sbc), the backup coefficient set value (MV_bc) is still "0%".

Meanwhile, because the gasholder pressure measurement value (PV_gh, 2.500 MPa) is greater than the production pressure set value (SV_a, 2.300 MPa), the production coefficient set value (MV_a) is changed from "100%" to "50%". The second control/command unit 507 calculates the target total computed supply quantity (MV_ta) by multiplying the current production quantity (total computed supply quantity CSV_ta) by the production coefficient set value (MV_a, 50%), and commands the air separation apparatus 100 so as to reach the target total computed supply quantity (MV_ta).

(Configuration of the Control Unit)

The configuration of the control unit 200 is illustrated. The control unit 200 controls the supply quantity (introduction quantity) of feed air when the quantity of product gas (high-purity oxygen gas) produced is varied. The control unit 200 can receive commands from the first and second control/command units 506 and 507 and thereby control the air separation apparatus 100.

For example, the control unit 200 can control the quantity of product gas produced by controlling the degree of opening of the discharge valve of the compressor C1 so as to control the discharge quantity from the compressor C1. The discharge quantity can be monitored by the flow rate measurement unit F1.

The control unit 200 has a pressure setting unit 201, a liquid level setting unit 202, a pressure adjustment unit 280, and an output quantity control unit 290.

The pressure setting unit 201 determines the pressure set value on the top section 43 of the low-pressure column 4 in accordance with measurement data from the flow rate measurement unit F1, which measures the quantity of introduced feed air supplied to the high-pressure column 2.

The pressure adjustment unit 280 adjusts the pressure of the top section 43 of the low-pressure column 4 by controlling the discharge quantity of waste gas discharged into the atmosphere which is output from the top section 43 of the low-pressure column 4, by way of a vent 54, so that the pressure data measured by the pressure measurement unit P14 reaches this pressure set value.

The liquid level setting unit 202 determines the liquid level set values (range from an upper limit to a lower limit) of the oxygen-enriched liquid stored in the bottom section 21 of the high-pressure column 2, according to the measurement data from the flow rate measurement unit F1. By controlling the degree of opening of the control valve V2, the output quantity control unit 290 adjusts the output quantity of the oxygen-enriched liquid sent from the bottom section 21 of the high-pressure column 2 to the rectification section 42 of the low-pressure column 4 so that the measurement data from the liquid level measurement unit 211 reaches this liquid level set value.

Further Mode of Embodiment

In the supply quantity adjustment device of the present Mode of Embodiment 1, high-purity oxygen gas is described, but there is no limitation to this, and the supply quantity can be adjusted in the same way for high-purity nitrogen gas and for argon gas.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

LIST OF REFERENCE NUMERALS

1 main heat exchanger
2 high-pressure column
21 bottom section
22 rectification section
23 top section
3 condenser
4 low-pressure column
41 bottom section
42 rectification section
44 top section
100 air separation apparatus
101 backup tank
400 plant
500 supply quantity adjustment device
501 total production reference quantity acquisition unit
502 total demand quantity calculation unit
503 excess/deficit information setting unit
504 backup coefficient setting unit
505 production coefficient setting unit
506 first control/command unit
507 second control/command unit
C1 compressor
P401 gasholder pressure measurement unit

What is claimed is:

1. A supply quantity adjustment method comprising the steps of:

a) calculating a total demand quantity used by at least one supply destination, based on plant information acquired from the at least one supply destination;

b) comparing the total demand quantity and a pre-set flow rate set value and setting a first calculated pressure value;

c) adjusting a backup coefficient set value based on a pre-set supply-destination reference gasholder pressure, the first calculated pressure value, a pre-set reference backup pressure set value, and a measured gasholder pressure value, which is a measured pressure value of the supply-destination gasholder; and d) adjusting a production coefficient by comparing a production pressure set value obtained by adding the pre-set supply destination reference gasholder pressure and a first pressure output value with the measured gasholder pressure value; and e) modifying a variation in product gas production quantity by an at least one air separation apparatus based on the production coefficient adjusted in step d).

2. The supply quantity adjustment method according to claim 1, further comprising the following steps of:

f) acquiring a total computed supply quantity of product gas that can be supplied from at the least one air separation apparatus and at least one backup device, or computing a total computed supply quantity;

g) commanding an outlet valve of the backup device or a gate valve or control valve installed on a piping connecting the at least one backup device and the at least one supply destination, based on the backup coefficient set value, to control starting of supply, variation of supply quantity, and stopping of supply, of the product gas from the backup device; and h) commanding the at least one air separation apparatus to maintain or vary the quantity of product gas produced by the air separation apparatus based on the production coefficient set value.

3. An information processing device including: at least one processor; and a memory for storing instructions executable by the processor, wherein the processor implements the supply quantity adjustment method according to claim 1 by executing executable instructions.

4. A supply quantity adjustment device, comprising:

a processor; and a memory coupled to the processor, the memory storing instructions that, when executed by the processor, cause the processor to perform operations comprising:

calculating a total demand quantity used at at least one supply destination, based on plant information acquired from the at least one supply destination;

comparing the total demand quantity and a pre-set flow rate set value and sets a first calculated pressure value;

setting a backup coefficient set value based on a pre-set supply-destination reference gasholder pressure, the first calculated pressure value, a pre-set reference backup pressure set value, and a measured gasholder pressure value, which is a measured pressure value of the supply-destination gasholder;

adjusting a production coefficient by comparing a production pressure set value obtained by adding the pre-set supply-destination reference gasholder pressure and a first pressure output value with the measured gasholder pressure value; and modifying a variation in the quantity of product gas produced by an at least one air separation apparatus based on the production coefficient.

5. The supply quantity adjustment device according to claim 4, wherein the processor further performs the following operations: controlling starting of supply, variation of supply quantity, and stopping of supply, of a product gas from the backup device based on the backup coefficient set value; and adjusting the quantity of product gas produced by the at least one air separation apparatus based on the production coefficient set value.

* * * * *